US008166614B2

(12) United States Patent
Martin

(10) Patent No.: US 8,166,614 B2
(45) Date of Patent: May 1, 2012

(54) AUXILIARY HANDLE FOR HAND-HELD POWER TOOL

(75) Inventor: Paul Martin, Karlsruhe (DE)

(73) Assignee: Hilti Aktiengesellschaft, Schaan (LI)

( * ) Notice: Subject to any disclaimer, the term of this patent is extended or adjusted under 35 U.S.C. 154(b) by 425 days.

(21) Appl. No.: 12/584,908

(22) Filed: Sep. 14, 2009

(65) Prior Publication Data

US 2010/0064480 A1 Mar. 18, 2010

(30) Foreign Application Priority Data

Sep. 15, 2008 (DE) ..... 10 2008 042 114

(51) Int. Cl.
*B25G 1/00* (2006.01)

(52) U.S. Cl. ..... 16/426; 16/422; 16/DIG. 25

(58) Field of Classification Search ..... 16/422, 16/426, 436, 437, 444, 446, DIG. 24, DIG. 25; 294/58; 408/124, 241 R; 173/161, 162.1, 173/162.2; 81/177.6, 177.7, 177.8, 177.9, 81/491

See application file for complete search history.

(56) References Cited

U.S. PATENT DOCUMENTS

| | | | | |
|---|---|---|---|---|
| 982,145 | A * | 1/1911 | Langlois | 294/58 |
| 4,175,298 | A | 11/1979 | Kottke | |
| 4,881,294 | A * | 11/1989 | Riedl | 16/426 |
| 5,687,483 | A * | 11/1997 | Neubert et al. | 30/312 |
| 6,499,172 | B1 | 12/2002 | Maccracken | |
| 6,553,627 | B1 * | 4/2003 | Horler | 16/426 |
| 6,814,156 | B2 * | 11/2004 | Dieterle et al. | 173/170 |
| 6,863,479 | B2 * | 3/2005 | Frauhammer et al. | 408/241 R |
| D572,563 | S * | 7/2008 | McRoberts et al. | D8/107 |
| 7,823,256 | B2 * | 11/2010 | Engelfried et al. | 16/426 |
| 8,032,990 | B2 * | 10/2011 | Shinma et al. | 16/426 |
| 2004/0163214 | A1 | 8/2004 | Cheng | |
| 2007/0209162 | A1 * | 9/2007 | McRoberts et al. | 16/426 |
| 2009/0000434 | A1 | 1/2009 | Shinma | |
| 2009/0178520 | A1 | 7/2009 | Engelfried | |
| 2009/0188083 | A1 * | 7/2009 | Hahn et al. | 16/426 |
| 2009/0307875 | A1 * | 12/2009 | Nakashima et al. | 16/436 |
| 2010/0005629 | A1 * | 1/2010 | Di Nicolantonio | 16/426 |

FOREIGN PATENT DOCUMENTS

| | | | |
|---|---|---|---|
| CH | 649733 | A * | 6/1985 |
| DE | 44 22 247 | A1 | 1/1996 |
| EP | 1 400 317 | B1 | 3/2004 |
| GB | 2124536 | A * | 2/1984 |
| JP | 06193459 | A * | 7/1994 |

* cited by examiner

*Primary Examiner* — Victor Batson
*Assistant Examiner* — Jeffrey O Brien
(74) *Attorney, Agent, or Firm* — Abelman, Frayne & Schwab

(57) ABSTRACT

An auxiliary handle for a hand-held power tool (7) includes a lockable lag hinge (46) provided between the clamping section (21) and the gripping member (34) and having a pivot pin (47), a tensioning member (51) for tightening and loosening the clamping section (21) and arranged on an end (48) of the pivot pin (47) of the lag hinge (46), a locking device (41) for locking and releasing the lag hinge (46), and an independent from the tensioning member (51), unlocking device (56) for releasing the locking device (41) and having an actuation member (62) upon actuation of which, the locking device (41) is displaced from its locking position in which the lag hinge (46) is locked to its release position in which the lag hinge (46) is released.

7 Claims, 2 Drawing Sheets

AUXILIARY HANDLE FOR HAND-HELD POWER TOOL

BACKGROUND OF THE INVENTION

1. Field of the Invention

The present invention relates to an auxiliary handle for a hand-held power tool such as a power drill, a hammer drill or a chisel hammer and includes a clamping section for securing the auxiliary handle on a section of the power tool, a gripping member for holding the auxiliary handle, a lockable lag hinge provided between the attachment section and the gripping member and having a pivot pin, a tensioning member for tightening and loosening the clamping section and arranged on an end of the pivot pin of the lag hinge, and a locking device for locking and releasing the lag hinge.

2. Description of the Prior Art

In power tools, auxiliary handles of the type described above are provided, if needed, in form of a side handle mounted, e.g., on a housing section adjacent to a tool holder for guiding the power tool. It is known to form a gripping member of the auxiliary handle pivotable about a pivot axis in order to optimally guide the power tool and to enable different gripping positions of the auxiliary handle on the power tool, which would insure a less tiring operation. A lag hinge provides for a pivotal movement of the gripping member relative to the attachment section of the auxiliary handle. The pivoting of the gripping member permits to adjust the gravity point of the power tool with respect to the tool user. Often, the gripping member is adjusted during the power tool use.

In order to prevent an inadvertent re-adjustment of the gripping member of the auxiliary handle in a locking position of the lag hinge, there are usually provided, e.g., between the clamping section and the gripping member, engageable in each other, toothings. For pivoting of the gripping member, this engagement should be broken and then again re-established. This occupies an increased amount of time.

German Publication DE 10 2006 055 524 A1 discloses an auxiliary handle for a hand-held power tool and having its clamping section formed as a clamping sleeve for mounting the auxiliary handle on a section of the power tool. The auxiliary handle also includes a gripping member for grasping and holding the auxiliary handle. Between the clamping section and the gripping member, a lockable lag hinge is arranged. The lag hinge has a pivot pin a longitudinal axis of which forms the pivot axis of the lag hinge. Further, there is provided an actuation knob that forms a locking member and is arranged on an end of the pivot pin, being secured on a section of the pivot pin provided with an outer thread. Between the tensioning member and a section of the gripping member, there is provide a cone-shaped, elastically deformable engagement member frictionally engageable in a conically widening recessed opening formed in a section of the gripping member. Between the gripping member and the clamping section, toothings are provided which form a locking device and which lock the lag hinge when formlockingly engaging each other, and release the lag hinge in their disengaged position.

With such design of the auxiliary handle, the required number of revolutions of the locking member for locking and releasing the lag hinge and for tightening and loosening the clamping section is reduced.

The drawback of the above-described auxiliary handle consists in that for releasing the lag hinge, the engaging each other, elements of the locking device should be spaced from each other by at least the height of the teeth so that the gripping member can be pivoted relative to the clamping section. This can lead to loosening of the tightening of the clamping section and thereby adversely affect its fixation on the power tool, so that the auxiliary handle can automatically pivot about an operational axis defined by a working tool. Therefore, with a new locking of the lag hinge, additionally, a proper orientation of the entire auxiliary handle relative to the power tool should be carefully readjusted.

Accordingly, an object of the present invention is an auxiliary handle for a hand-held power tool in which the above-discussed drawbacks of a known auxiliary handle are eliminated.

Another object of the present invention is an auxiliary handle for a hand-held power tool and that would enable a simple and rapid pivoting of the gripping member, without affecting the tightening of the clamping section.

SUMMARY OF THE INVENTION

These and other objects of the present invention, which will become apparent hereinafter, are achieved by providing an unlocking device, which is independent from the tensioning member and has an actuation member upon actuation of which, the locking device is displaced from its locking position in which the lag hinge is locked to its release position in which the lag hinge is released.

Upon actuation of the actuation member that, advantageously, can be effected only with one finger of one hand, the locking of the lag hinge is lifted off, without loosening of the clamping section, e.g., relaxation of the tightening band. The two functions of the auxiliary handle, namely, securing of the gripping member of the auxiliary handle on the power tool and pivotability of the gripping member toward the operational direction are separated from each other. After the gripping member has been pivoted about the pivot axis into a desired position relative to the power tool the lag hinge does not occupy its release position but becomes locked again.

Advantageously, the actuation member is provided on a section of the gripping member, which provides for an easy actuation of unlocking device. More advantageously, the actuation member is provided on a section of the gripping member easily accessible from outside.

Advantageously, the actuation member is provided at an end of the pivot pin opposite the end on which the tensioning member is arranged. It provides for an advantageous construction of the auxiliary handle and, thus, its advantageous manufacturing. This also insures a simple operation of the unlocking device.

Advantageously, the actuation member is formed as a pressure knob axially displaceable along the pivot axis of the lag hinge. This provides for an easy actuation of the unlocking device and its operation.

Advantageously, the locking device includes at least one locking member axially displaceable by the actuation member relative to the pivot axis of the lag hinge and engageable with a section of the gripping member for locking the lag hinge. The at least one locking member has a stop section that, together with a stop counter-section provided on the gripping member, prevents the cooperating parts from rotation relative to each other in the locked position of the lag hinge. Upon actuation of the actuation member, only the connection between the at least one locking member and the gripping member is lifted off, which provides for a simple pivotal movement of the gripping member of the auxiliary handle into a desired position. As soon as the desired position of the gripping member is reached, the at least one locking member is again displaced into its locking position in which it again becomes engaged with the gripping member.

Advantageously, the at least one locking member has a toothing engaging, in a locking position of the lag hinge, a counter-toothing provided on the section of the gripping member.

Advantageously, the counter-toothing is formed complementary to the toothing on the at least one locking member. The formlocking connection between the at least one locking member and the gripping member permits to transmit greater forces than a simple frictional connection. Upon actuation of the actuation member, the toothed connection is lifted off or becomes disengaged.

Advantageously, there is provided a spring for biasing the at least one locking member in direction of the actuation member.

The spring, e.g., a helical spring functions as a return member, so that the at least one locking member is automatically displaced in its locking position for locking the lag hinge.

Advantageously, the locking device has two locking members, which, upon actuation of the actuation member are simultaneously displaced from a position in which the lag hinge is locked, to a position in which the lag hinge is released.

With the two locking members, there are provided two, spaced from each other, stop points, which advantageously insures locking of the lag hinge also during a chiseling operation of the power tool.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS

The drawings show.

In the drawings, the same parts are designated with the same reference numerals.

DETAILED DESCRIPTION OF THE PREFERRED EMBODIMENT

Figure 1:
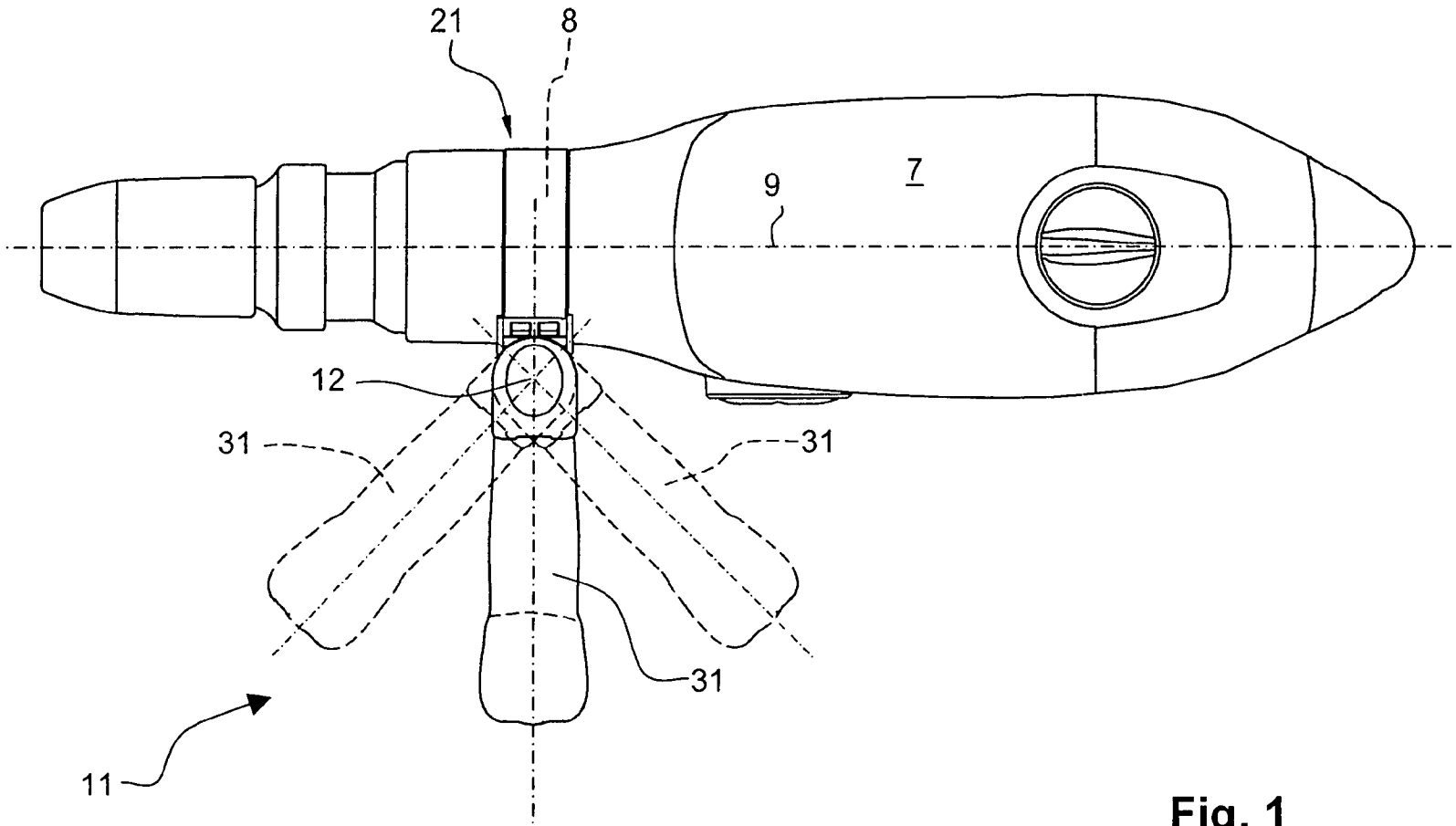
FIG. 1 a plan view of a hand-held power tool with an auxiliary handle according to the present invention.

A hand-held power tool 7, which is shown in FIG. 1, includes an auxiliary handle 11 according to the present invention that is formed as a side handle and is releasably secured on a cylindrical section 8 of the power tool 7. The auxiliary handle 11 has a gripping member 31 for grasping and holding the auxiliary handle 11 and pivotable about a pivot axis 12 toward an operational axis 9 of the power tool 7 to adapt to the gripping position on the power tool 7, when needed.

Figure 2:
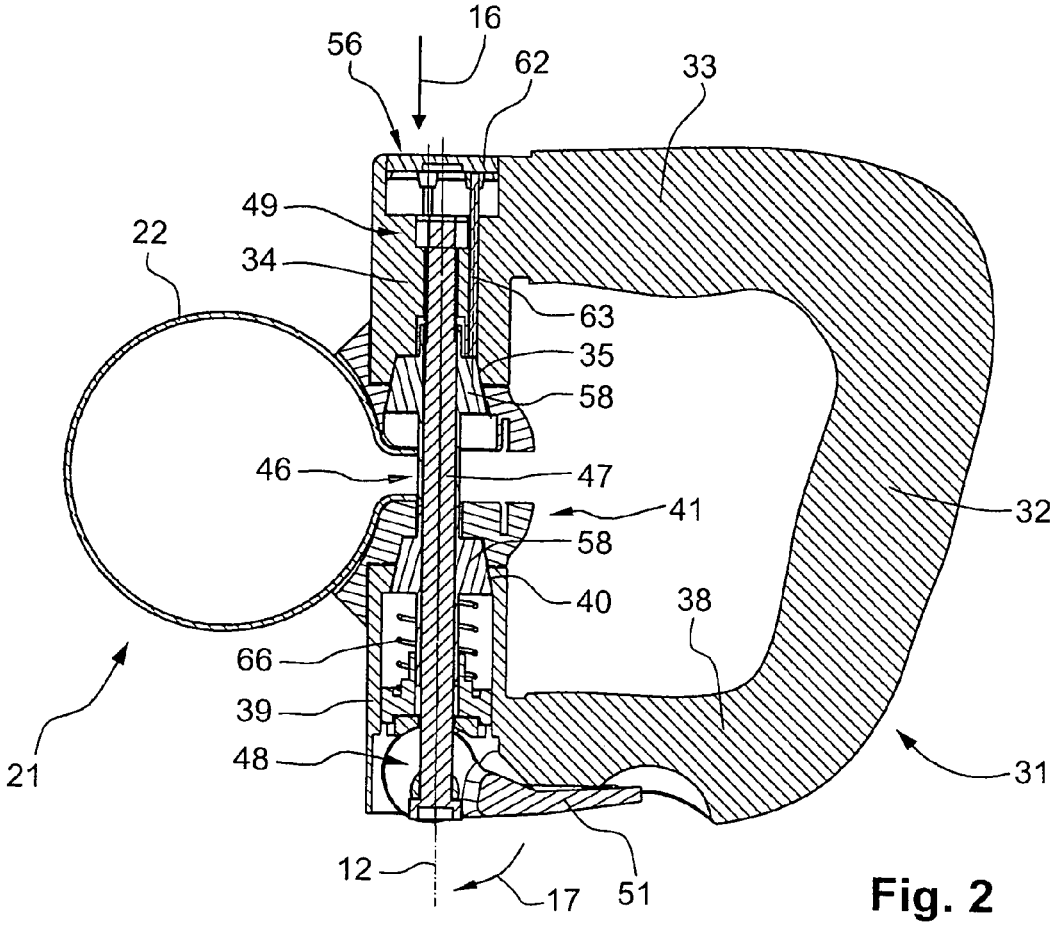
FIG. 2 a cross-sectional view of the auxiliary handle along its pivot axis with its locking device in the locking position.
Figure 3:
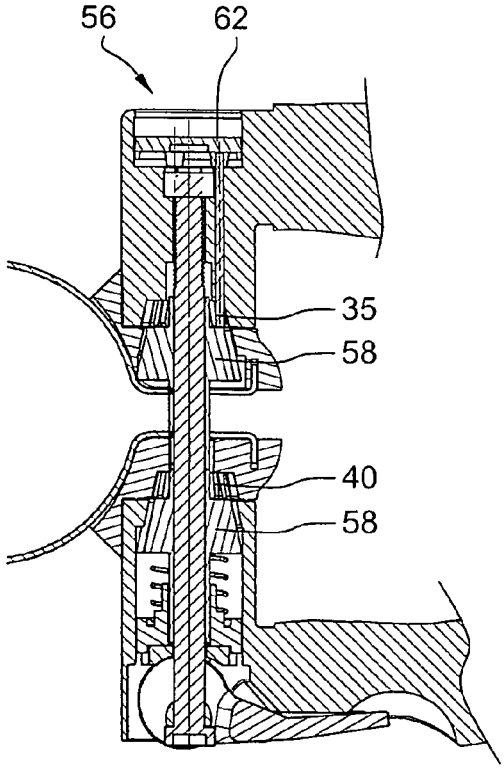
FIG. 3 a cross-sectional view similar to that of FIG. 2 but with the locking device in its release position.

The auxiliary handle 11 has, as shown in FIGS. 2-3, a clamping section 21 for securing the auxiliary handle 11 on the power tool 7 and having a tightening band 22.

The gripping member 31 of the auxiliary handle 11 is essentially U- or D-shaped and has a base 32 and two legs 33 and 38 projecting from the base 32. On the leg 33, there is provided a first bearing section 34 adjacent to the second leg 38, and on the leg 38, there is provided a second bearing section 39 adjacent to the first leg 33.

Between the clamping section 21 and the gripping member 31, there is provided a lockable lag hinge 46 having a pivot pin 47 having a longitudinal axis that forms the pivot axis 12. The pivot pin 47 is fixedly secured at its end 49 in the first bearing section 34. A tensioning member 51 for tightening and releasing the clamping section 21 is provided at the opposite end 48 of the pivot pin 47 in the region of the leg 38 of the gripping member 31. The tensioning member 51 is formed as an eccentric lever. Upon turning of the eccentric lever, the clamping section 21 is tightened when the eccentric lever crosses its dead point and a locking device 41 is displaced in its locking position for locking the lag hinge 46. With the pivoting of the tensioning member 51 in the opposite direction shown with arrow 17, the tightening of the clamping section 51 is easily released, so that the auxiliary handle 11 can be pivoted about an operational axis 9 of the power tool 7 or can be removed from the power tool 7.

On a section of the gripping member 31, in the region of first bearing section 34, there is further provided an unlocking device 56 which is independent from the tensioning member 51. The unlocking device 56 has an actuation member 62 upon actuation of which, the locking device 41 is displaced form its locking position in which the lag hinge 46 is locked, to its release position for releasing the lag hinge 46. The actuation member 62 is provided on the end 49 of the pivot pin 47 which is opposite the end 48 of the pivot pin 47 at which the tensioning member 51 is located.

The locking device 41, which is provided between the clamping section 21 and the gripping member 31, includes a toothed connection that should be broken for pivoting the gripping member 31 relative to the clamping section 21. The locking device 41 includes two locking members 58 connectable with each other by a connection sleeve 60 and axially displaceable relative to the pivot axis 12 of the lag hinge 46 by the actuation member 62. For locking the lag hinge 46, the two locking members 58 are brought in an abutting engagement with respective sections 35 and 40 of the gripping member 31 and which are formed as conical recesses. Both conical recesses are similarly oriented. The two, likewise conical, locking members 58 are provided on their respective outer conical surfaces, which form locking sections, with a toothing that engages, in the locking position of the lag hinge, a counter-toothing provided on the respective inner conical surfaces of the corresponding sections 35 and 40 of the gripping member 31 which form counter-locking sections.

The actuation member 62 is formed as a pressure knob axially displaceable along the pivot axis 12 of the lag hinge 46. The actuation member 62 is provided with a pin-shaped transmission member 63 for transmitting the relative movement of the actuation member 62 to the locking members 58.

The pivot pin 47 extends through the ends of the tightening band 22, the locking members 58, the connection sleeve 60, and the bearing sections 34 and 39, so these elements form respective articulation sleeves of lag hinge 46.

In the bearing section 39, there is arranged a spring 66 that is formed as a helical spring surrounding the pivot pin 47. The spring 66 biases the two locking members 58 in direction of the actuation member 62.

Upon tightening of the clamping section 21 with the tensioning member 51, the bearing sections 34 and 39 are displaced toward each other, whereby the locking members 58 formlockingly engage in the recesses 35 and 40 in the bearing sections 33 and 38, respectively. This insures that the auxiliary handle 11 is reliably secured on the power tool 7 also during a chiseling operation of power tool 7.

For pivoting the gripping member 31 relative to the clamping section 21, the actuation member 62, upon being depressed, is displaced axially in direction of arrow 16 along the pivot axis 12. This movement of the actuation member 62 is transmitted by the transmission member 63 to the upper locking member 58 that is displaced, together with the other locking member 58, against the biasing force of the spring 66 in the direction of the tensioning member 51. In this position of the unlocking device 56, the lag hinge 46 is released, and the gripping member 31 can be pivoted in a desired position, without affecting the tightening condition of the clamping section 21 and, thus, the securing of the auxiliary handle 11 on the power tool 7.

After the desired position of the gripping member 31 relative to the clamping section 21 is reached, the actuation member 62 is released whereby it is displaced in its initial position by spring-biased locking members 58 displaceable into engagement with the recesses 35 and 40 of the bearing sections 33 and 38. In this position, the unlocking device 56 provides for locking anew the lag hinge 46. The tightening of the clamping section 21 is not disturbed during the entire adjustment process of the gripping member 31.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. An auxiliary handle for a hand-held power tool (7), comprising:

a clamping section (21) for securing the auxiliary handle (11) on a section of the power tool (7);

a gripping member (31) for holding the auxiliary handle (11);

a lockable lag hinge (46) provided between the clamping section (21) and the gripping member (31) and having a pivot pin (47);

a tensioning member (51) for tightening and loosening the clamping section (21) and arranged on an end (48) of the pivot pin (47) of the lag hinge (46);

a locking device (41) for locking and releasing the lag hinge (46); and an unlocking device (56), independent from the tensioning member (51) wherein the unlocking device (56) does not cause the clamping section (21) to tighten or loosen during adjustment of the gripping member (31) with respect to the clamping section (21), the unlocking device (56) for releasing the locking device (41) and having an actuation member (62) upon actuation of which, the locking device (41) is displaced from a locking position thereof in which the lag hinge (46) is locked to a release position thereof in which the lag hinge (46) is released;

wherein the locking device (41) comprises at least one locking member (58) axially displaceable by the actuation member (62) relative to the pivot axis (12) of the lag hinge (46) and engageable with a section (35, 40) of the gripping member (31) for locking the lag hinge (46), wherein the at least one locking member (58) has a toothing, a counter-toothing provided on the section (35, 40) of the gripping member (31), wherein the toothing of the at least one locking member (58) engages the counter-toothing provided on the section (35, 40) of the gripping member in the locking position of the lag hinge (46) and is disengaged from the counter-toothing in the release position of the lag hinge (46).

2. An auxiliary handle according to claim 1, wherein the actuation member (62) is provided on a section of the gripping member (31).

3. An auxiliary handle according to claim 1, wherein the actuation member (62) is provided at an end (49) of the pivot pin (47) opposite the end (48) on which the tensioning member (51) is arranged.

4. An auxiliary handle according to claim 1, wherein the actuation member (62) comprises a pressure knob axially displaceable along a pivot axis (12) of the lag hinge (46).

5. An auxiliary handle according to claim 1, wherein the actuation member (62) is provided with a transmission member (63) for transmitting a relative movement of the actuation member (62) to the at least one locking member (58).

6. An auxiliary handle according to claim 1, comprising a spring (66) for biasing the at least one locking member (58) in direction of the actuation member (62).

7. An auxiliary handle according to claim 1, comprising a further locking member (58), and wherein upon actuation of the actuation member (62), both the at least one locking member (58) and the further locking member (58) are simultaneously displaced from a position in which the lag hinge (46) is locked, to a position in which the lag hinge (46) is released.

* * * * *